US005122843A

United States Patent [19]

Yokoyama et al.

[11] Patent Number: 5,122,843

[45] Date of Patent: Jun. 16, 1992

[54] IMAGE FORMING APPARATUS HAVING DEVELOPING DEVICES WHICH USE DIFFERENT SIZE TONER PARTICLES

[75] Inventors: Tomoaki Yokoyama; Tateki Oka, both of Toyohashi; Kunio Toda, Itami, all of Japan

[73] Assignee: Minolta Camera Kabushiki Kaisha, Osaka, Japan

[21] Appl. No.: 654,805

[22] Filed: Feb. 13, 1991

[30] Foreign Application Priority Data

Feb. 15, 1990 [JP] Japan ..... 2-34773
Aug. 31, 1990 [JP] Japan ..... 2-232204

[51] Int. Cl.[5] ..... G03G 15/01

[52] U.S. Cl. ..... 355/326; 355/245; 430/45; 430/111

[58] Field of Search ..... 355/245, 326, 327, 251; 430/45, 111, 120, 122; 118/653, 656, 657, 658, 645

[56] References Cited

U.S. PATENT DOCUMENTS 4,351,604 9/1982 Karasawa et al. ..... 355/245 X
4,416,533 11/1983 Tokunaga et al. ..... 355/326
4,819,028 4/1989 Abe ..... 355/326
4,822,702 4/1989 Hoshi et al. ..... 430/42
4,833,505 5/1989 Furuya et al. ..... 355/326
4,935,782 6/1990 Kohyama ..... 355/245
4,992,831 2/1991 Kunishi ..... 355/245
5,009,973 4/1991 Yoshida et al. ..... 430/45

FOREIGN PATENT DOCUMENTS 0157176 6/1988 Japan .

*Primary Examiner*—A. T. Grimley
*Assistant Examiner*—Robert Beatty
*Attorney, Agent, or Firm*—Burns, Doane, Swecker & Mathis

[57] ABSTRACT

An image forming apparatus includes an image support member; a first electrostatic latent image forming device for forming a first electrostatic latent image on the image support member; a first developing device for developing the first electrostatic latent image with first toner; a second electrostatic latent image forming device for forming a second electrostatic latent image on the image support member; and a second developing device for developing the second electrostatic latent image with second toner; the second toner having a color different from that of the first toner and having charging characteristics relative to carrier, identical with those of the first toner; the second toner having an average particle diameter larger than that of the first toner.

13 Claims, 12 Drawing Sheets

1st corona charging

1st exposure

1st development

2nd corona charging

2nd exposure

2nd development

Transfer

1st corona charging

1st exposure

1st development

Masking

2nd corona charging

2nd exposure

2nd development

Transfer

IMAGE FORMING APPARATUS HAVING DEVELOPING DEVICES WHICH USE DIFFERENT SIZE TONER PARTICLES

BACKGROUND OF THE INVENTION

The present invention relates to a multi-color image forming method employing electrophotographic copying process and its apparatus.

Conventionally, as a multi-color image forming apparatus employing electrophotographic copying process, a two-color image forming apparatus, for example, is proposed in which two sets of copying processes are provided around a photosensitive member and each of the copying processes includes a corona charger for charging a surface of the photosensitive member to a predetermined potential, an exposure device for irradiating image light onto the photosensitive member charged by the corona charger and a magnetic brush type developing device utilizing two-component developer composed of toner and carrier. Thus, in the first copying process, a first electrostatic latent image formed on the photosensitive member is developed by first toner so as to form a first toner image. Meanwhile, in the second copying process, a second electrostatic latent image is developed by second toner having not only a color different from that of the first toner but charging characteristics relative to the carrier, identical with those of the first toner so as to form a second toner image such that the first and second toner images on the photosensitive member are transferred at a time.

However, in the known two-color image forming apparatus, such a problem arises that since the second developing device is of magnetic brush type in which development is performed through contact of a magnetic brush with the surface of the photosensitive member, the first toner image formed in the first copying process is brought into contact with the second toner having the color different from that of the first toner, in the second copying process and thus, the second toner is mixed into the first toner image, thereby resulting in mixing of the colors in the first toner image.

Therefore, in order to prevent mixing of the second toner into the first toner image in the known two-color image forming apparatus, such measures have been taken that a developing bias applied to the second developing device is made higher than that of the first developing device as proposed in U.S. Pat. No. 4,416,533 or in the second copying process, a surface potential of the photosensitive member and a surface potential of the first toner image are made higher than the developing bias of the second developing device.

However, even if the above mentioned measures are taken, it is still impossible to eliminate mixing of the second toner into the first toner image. Thus, when a quantity of mixing of the second toner into the first toner image exceeds a certain value, presence of the second toner in the first toner image becomes conspicuous, thereby resulting in deterioration of image quality.

SUMMARY OF THE INVENTION

Accordingly, an essential object of the present invention is to provide a multi-color image forming apparatus which is capable of forming an image free from mixing of colors.

Another important object of the present invention is to provide a multi-color image forming apparatus employing a magnetic brush type developing device, in which quantity of second toner mixed into an image formed by first toner is minimized such that mixing of the colors can be restricted to a negligible level for practical use.

Still another object of the present invention is to provide a multi-color image forming apparatus in which probability of mixing of the colors is remarkably low even if the second toner is brought into contact with the first toner image.

In order to accomplish these objects of the present invention, an image forming apparatus according to one embodiment of the present invention comprises: an image support member; a first electrostatic latent image forming means for forming a first electrostatic latent image on said image support member; a first developing means for developing the first electrostatic latent image with first toner; a second electrostatic latent image forming means for forming a second electrostatic latent image on said image support member; and a second developing means for developing the second electrostatic latent image with second toner; the second toner having a color different from that of the first toner and having charging characteristics relative to carrier, identical with those of the first toner; the second toner having an average particle diameter larger than that of the first toner.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
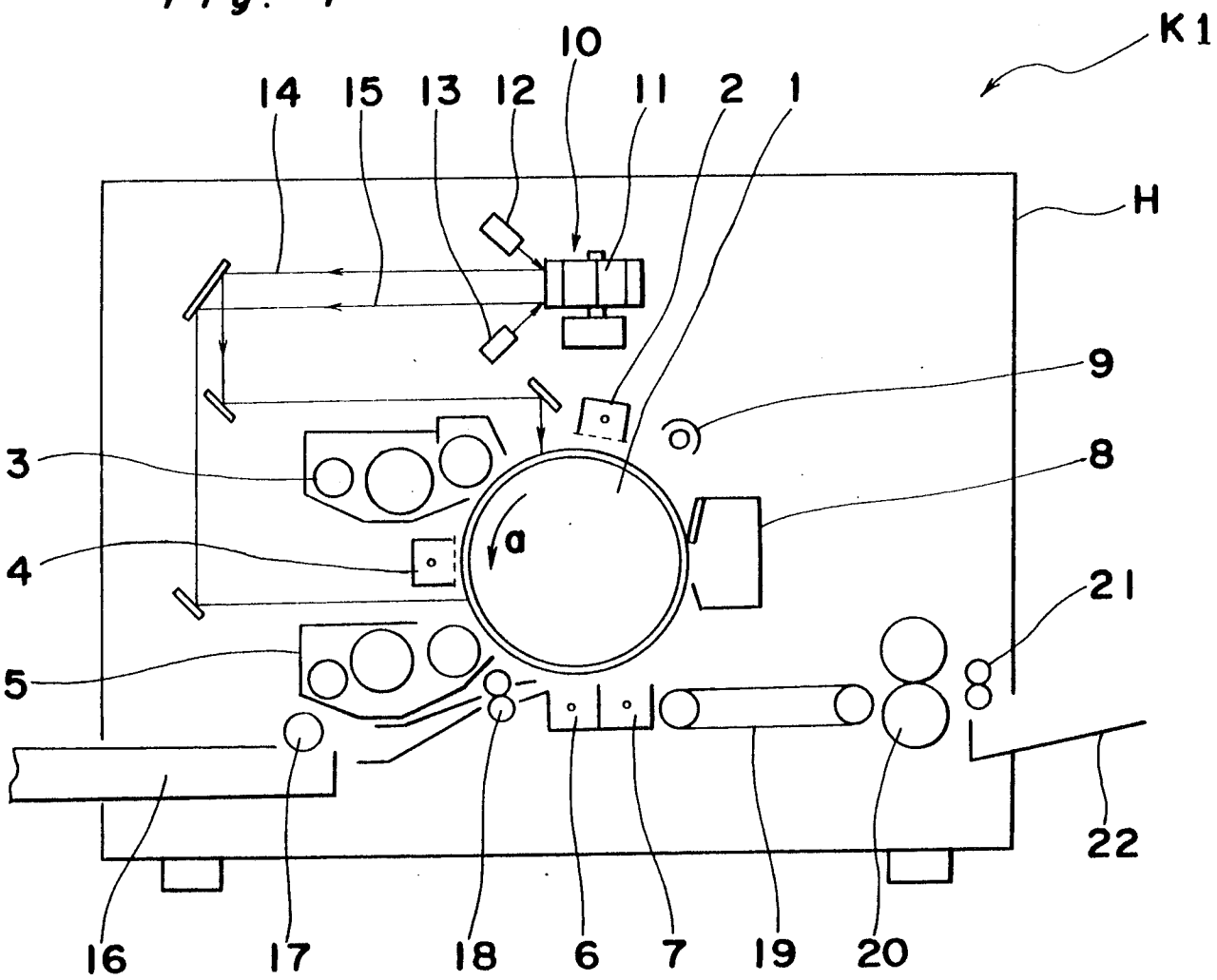
FIG. 1 is a schematic sectional view of an image forming apparatus according to a first embodiment of the present invention.

Referring now to the drawings, there is shown in FIG. 1, an image forming apparatus K1 according to a first embodiment of the present invention.

I. [Arrangement of the Image Forming Apparatus K1]

In the apparatus K1, a first corona charger 2, a first developing device 3, a second corona charger 4, second developing device 5, a transfer charger 6, a separation charger 7, a cleaning device 8 and an eraser lamp 9 are sequentially provided around a photosensitive member 1.

An optical system 10 includes a rotary polygon mirror 11, a first laser head 12, a second laser head 13, etc. A paper feeder 16 is provided at a left side of FIG. 1, while a fixing device 20 is provided at a right side of FIG. 12.

Figure 2:
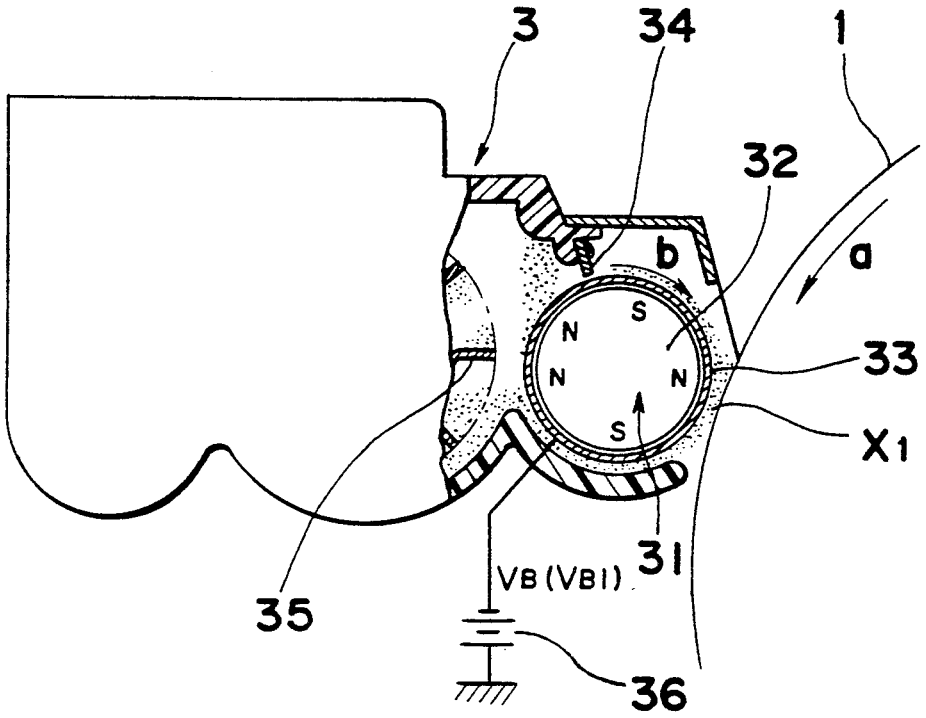
FIG. 2 is a partially cutaway side elevational view of a first developing device employed in the image forming apparatus of FIG. 1.
Figure 3:
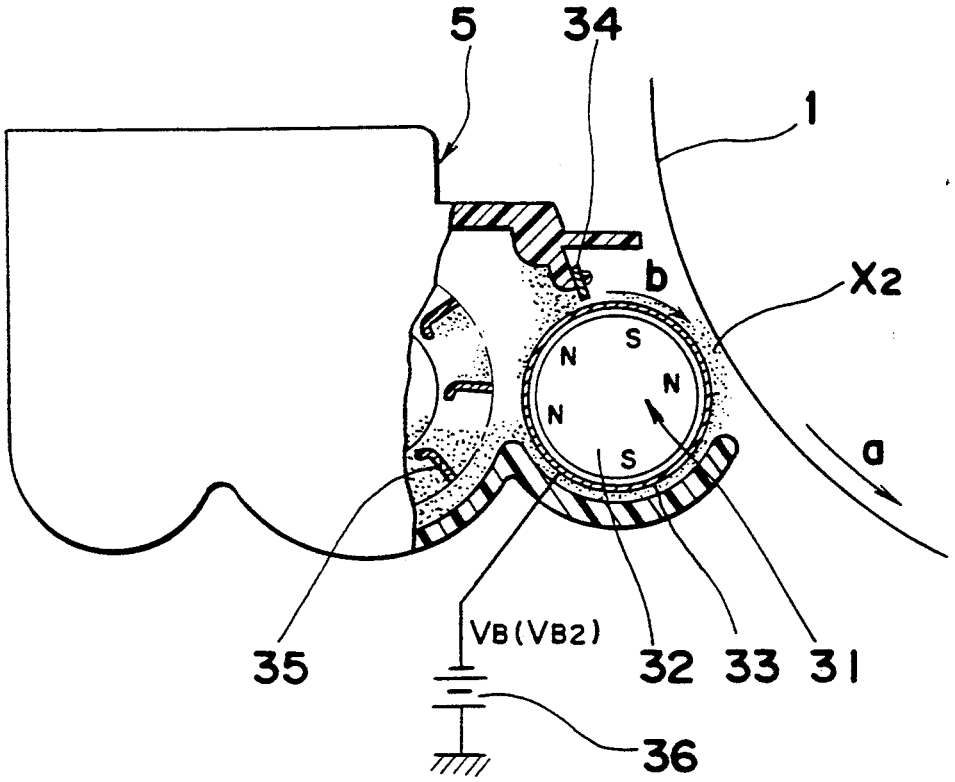
FIG. 3 is a partially cutaway side elevational view of a second developing device employed in the image forming apparatus of FIG. 1.
Figure 4A:
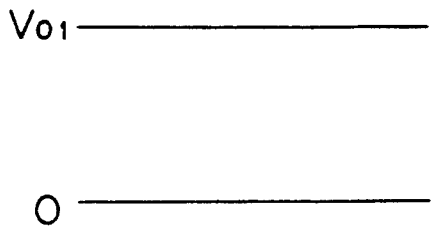
FIGS. 4*a* to 4*g* are views explanatory of image forming processes in the image forming apparatus of FIG. 1.
Figure 4B:
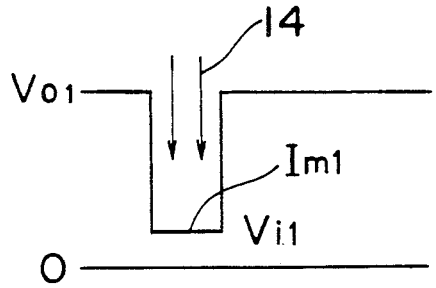
Figure 4C:
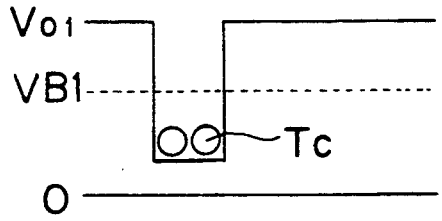
Figure 4D:
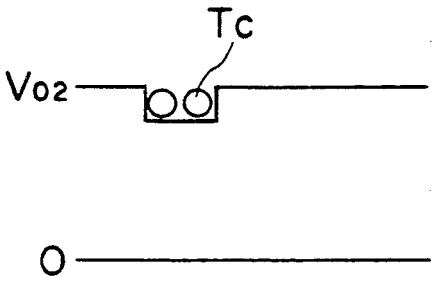
Figure 4E:
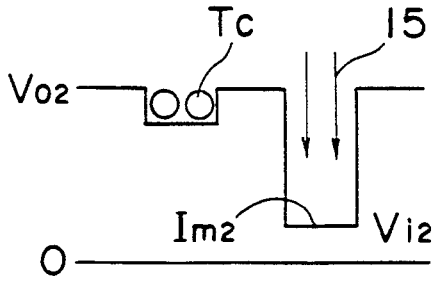
Figure 4F:
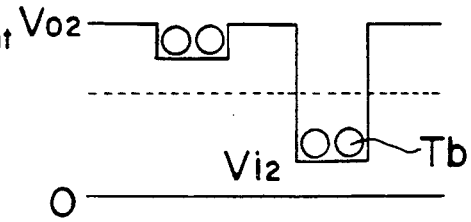
Figure 4G:
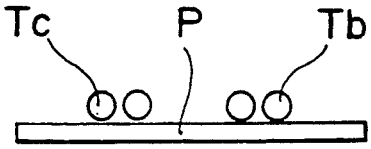

The first and second developing devices 3 and 5 shown in FIGS. 2 and 3, respectively are of magnetic brush type and are structurally identical with each other. Thus, only the first developing device 3 is described for the sake of brevity. The first developing device 3 includes a developing roller 31 and a developer feeding member 35. The developing roller 31 is constituted by a magnetic member 32 and a cylindrical sleeve 33 fitted around the magnetic member 32. A plurality of axially extending magnetic poles are provided along a circumference of the magnetic member 32. At a portion of the magnetic member 32 confronting the developer feeder 35, neighboring magnetic poles are of the same polarity. The sleeve 33 is rotated in the direction of the arrow b and receives a developing bias VB1. In FIG. 3, it is to be noted that a developing bias VB2 is applied to the sleeve 33.

Meanwhile, two-component developer including non-magnetic color toner having a color other than black and carrier is accommodated in the first developing device 3. On the other hand, two-component developer including magnetic black toner and carrier is accommodated in the second developing device 5. Both the color toner and the black toner have such a property as to be charged to an identical polarity through their contact with the carrier.

II. [Two-color Image Forming Operations]

Hereinbelow, two-color image forming operations of the apparatus K1 of the above described arrangement are described with reference to FIGS. 4*a* to 4*g*.

(a) First corona charging (FIG. 4*a*):

When a print command is issued, the photosensitive member 1 is rotated in the direction of the arrow a and the first corona charger 2 performs electric discharge so as to charge an outer peripheral surface of the photosensitive member 1 to a predetermined surface potential $V_{01}$ of −600 V. In the first and second developing devices 3 and 5, the developing sleeve 33 is rotated in the direction of the arrow b and the developing biases VB1 and VB2 are, respectively, set at −450 V and −550 V.

(b) First exposure (FIG. 4*b*):

Subsequently, a laser beam 14 corresponding to the color image is emitted from the first laser head 12 to the rotary polygon mirror 11 and its reflected beam is irradiated, via mirrors, for exposure onto an exposure portion of the photosensitive member 1 from between the first corona charger 2 and the first developing device 3 so as to set a surface potential $V_{il}$ of the exposure portion at −50 V such that a first electrostatic latent image $I_{ml}$ is formed.

(c) First development (FIG. 4*c*):

Through travel of the photosensitive member 1, the first electrostatic latent image $I_{ml}$ is transported to a region confronting the first developing device 3 (referred to as a "first developing region $X_1$", hereinbelow) so as to be developed into a visible image. At this time, in the first developing device 3, the first developer is supplied to the sleeve 33 while being mixed with the carrier in the developer feeder 35. The developer supplied to the sleeve 33 forms a magnetic brush along a line of magnetic force of the magnetic member 32 and is conveyed in the direction of the arrow b through rotation of the sleeve 33. Then, the developer passes by a distal end of a regulating plate 34 so as to be carried to the first developing region $X_1$.

In the first developing region $X_1$, color toner Tc charged to negative polarity adheres to the first electrostatic latent image $I_{m1}$ due to an electrostatic contrast of 400 V between the developing bias VB1 of −450 V and the surface potential $V_{i1}$ of −50 V at the exposure portion of the photosensitive member 1 so as to develop the first electrostatic latent image $I_{m1}$ into a visible color toner image.

(d) Second corona charging (FIG. 4*d*):

Thereafter, when the photosensitive member reaches an area confronting the second corona charger 4, the outer peripheral surface of the photosensitive member 1 is again charged to a surface potential $V_{02}$ of −700 V.

(e) Second exposure (FIG. 4*e*):

A laser beam 15 corresponding to a black image is emitted from the second laser head 13 to the rotar polygon mirror 11 and its reflected beam is irradiated, through mirrors, for exposure onto an exposure portion of the photosensitive member 1 from between the second corona charger 4 and the second developing device 5 so as to set a surface potential $V_{i2}$ of the exposure portion at −60 V such that a second electrostatic latent image $I_{m2}$ is formed.

(f) Second development (FIG. 4*f*):

At a second developing region $X_2$, black toner Tb charged to negative polarity is supplied from the second developing device 5 to the second electrostatic latent image $I_{m2}$ due to an electrostatic contrast of 490 V between the second developing bias VB2 of −550 V and the surface potential $V_{i2}$ of −60 V at the exposure portion of the photosensitive member 1 so as to develop the second electrostatic latent image $I_{m2}$ into a black toner image.

The electrostatic contrast of 490 V at the second developing region $X_2$ is made larger than the electrostatic contrast of 400 V at the first developing region $X_1$ for the following purpose. Namely, the magnetic black toner Tb itself is subjected to a restrictive force of the magnetic member 32 in the second developing device 5. Thus, an electrostatic attractive force relative to the black toner Tb is increased by increasing the electrostatic contrast at the second developing region $X_2$ so as to raise an adhesive force of the black toner Tb relative to the photosensitive member 1 such that density of the image is secured.

(g) Transfer, etc. (FIG. 4*g*):

The color toner Tc and the black toner Tb, which have adhered to the outer peripheral surface of the photosensitive member 1 as described above, are transferred to a transfer medium P at a portion of the photosensitive member 1 confronting the transfer charger 6.

The transfer medium P is supplied into an apparatus housing H of the apparatus K1 from the paper feeder 16 by a paper feeding roller 17 and is transported to the portion of the photosensitive member 1 confronting the transfer charger 6, synchronously with the above mentioned toner image by timing rollers 18. The transfer medium P having the color toner Tc and the black toner Tb transferred thereto is separated from the surface of the photosensitive member 1 by the separation charger 7 and is conveyed by a transport belt 19 to the fixing device 20 at which the color toner Tc and the black toner Tb are heated so as to be fixed on the transfer medium P.

The transfer medium P having the color toner Tc and the black toner Tb fixed thereon is ejected onto a discharge tray 22 by outlet rollers 21.

On the other hand, after the color toner Tc and the black toner Tb have been removed from the photosensitive member 1 at the portion of the photosensitive member 1 confronting the transfer charger 6, residual toner is removed from the photosensitive member 1 by the cleaning device 8. Subsequently, residual current is erased from the photosensitive member 1 by the eraser lamp 9 such that the photosensitive member 1 is ready for the next first exposure of FIG. 4*a*.

III. [Mechanism of mixing of colors]

When the two-color image is formed in this apparatus K1, the color toner image formed in the first developing device 3 passes through the second developing region $X_2$ of the second developing device 5. Therefore, at this time, the black toner is brought into contact with the color toner image so as to adhere thereto, thus resulting in mixing of the colors.

(i) A mechanism of mixing of the colors is described, hereinbelow. At the second developing region $X_2$, the magnetic brush developer held on the sleeve 33 are brought into contact with the surface of the photosensitive member 1. If the first toner image formed by the color toner is transported to the second developing region $X_2$ in this state, a part of the color toner is scraped from the photosensitive member 1 by the magnetic brush of the second developing device 5. An air gap or a recess is formed at the location of the photosensitive member 1 where the part of the color toner has been scraped. In almost all cases, the black toner having a particle diameter smaller than that of the scraped color toner penetrates into the recess.

Namely, it is considered that mixing of the colors takes place when the black toner having a particle diameter smaller than that of the scraped color toner penetrates into the recess at which the color toner has been scraped by the magnetic brush of the black toner.

Accordingly, it is assumed that if particle diameters of the color toner and particle diameters of the black toner are so set as to have a fixed relation, a quantity of the black toner penetrating into the recess in place of the color toner can be reduced so as to lower degree of mixing of the colors to such a level that the black toner is not visible noticeably.

Figure 5:
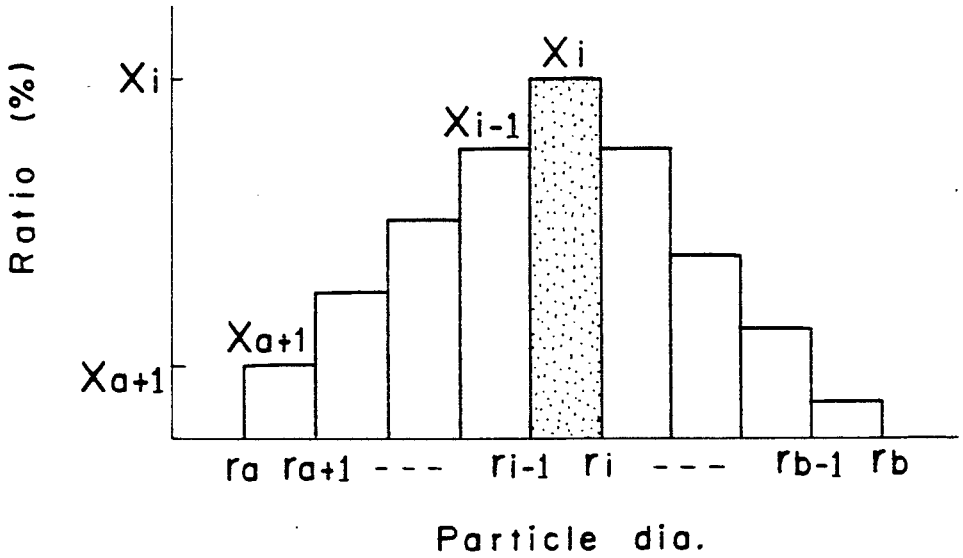
FIG. 5 is a graph showing distribution of particle diameters of first toner employed in the image forming apparatus of FIG. 1.
Figure 6:
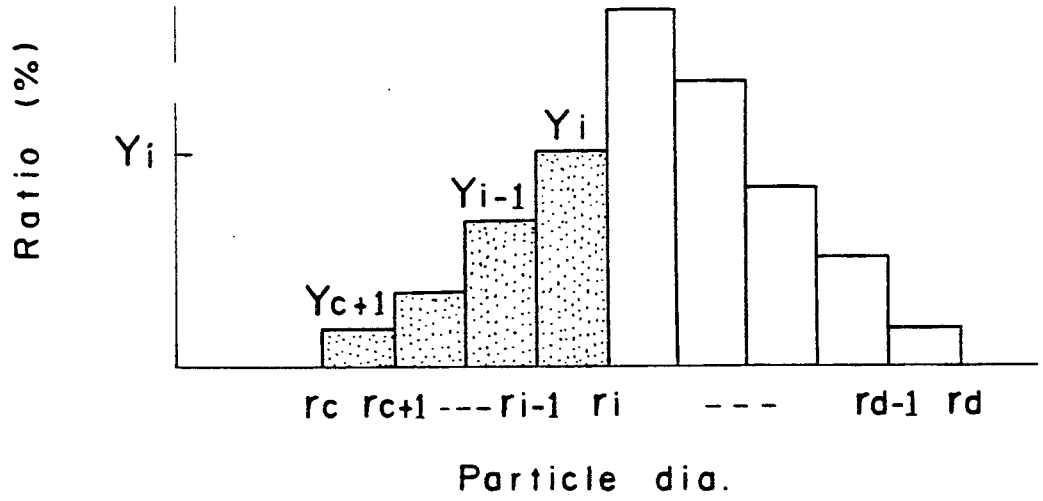
FIG. 6 is a graph showing distribution of particle diameters of second toner employed in the image forming apparatus of FIG. 1.

(ii) Thus, the first toner having distribution of particle diameters shown in FIG. 5 and the second toner having distribution of particle diameters shown in FIG. 6 are employed and degree of mixing of the second toner into the image formed by the first toner is examined. As described above, the first toner of the first toner image is scraped at the second developing region $X_2$ and size of the recess formed at the scraped first toner corresponds to distribution of particle diameters of the first toner. Namely, probability that size of the recess ranges from $r_{i-1}$ to $r_i$ assumes $X_i$ % as shown in FIG. 5. Then, a particle diameter of the second toner entering the above mentioned recess is equal to or smaller than that of the first toner located at the recess.

Therefore, if a particle diameter of the first toner scraped from location of the recess ranges from $r_{i-1}$ to $r_i$, a probability P that the second toner enters the recess is expressed by the following equation as shown in FIG. 6.

$$P_i=(\tfrac{1}{2})Y_i+Y_{i-1}+\cdots+Y_{c+1}$$

In the above equation, the coefficient "178 " of the term "$(\tfrac{1}{2})Y_i$" is a compensation coefficient for compensating that the first toner and the second toner fall in an identical range of particle diameters from $r_{i-1}$ to $r_i$.

From the above, assuming that size of the recess ranges from $r_{i-1}$ to $r_i$, a probability $K_i$ that the second toner enters the recess is given by the following equation.

$$K_i=X_i\cdot P_i=X_i\cdot\{(\tfrac{1}{2})Y_i+Y_{i-1}+\cdots+Y_{c+1}\}$$

Accordingly, when the probability $K_i$ is obtained for all the ranges of particle diameters of the first toner and a total K ($=\Sigma K_i$) of the probability $K_i$ is a value representing feasibility of entry of the second toner into the recess of the first toner, in other words, likelihood of mixing of the colors (hereinbelow, referred to as an "evaluation coefficient for evaluating mixing of the colors").

$$K=\sum_{i=a+1}^{b}\left[X_i\cdot\left\{(\tfrac{1}{2})Y_i+\sum_{i=c+1}^{i-1}Y_i\right\}\right] \quad (1)$$

Figure 7:
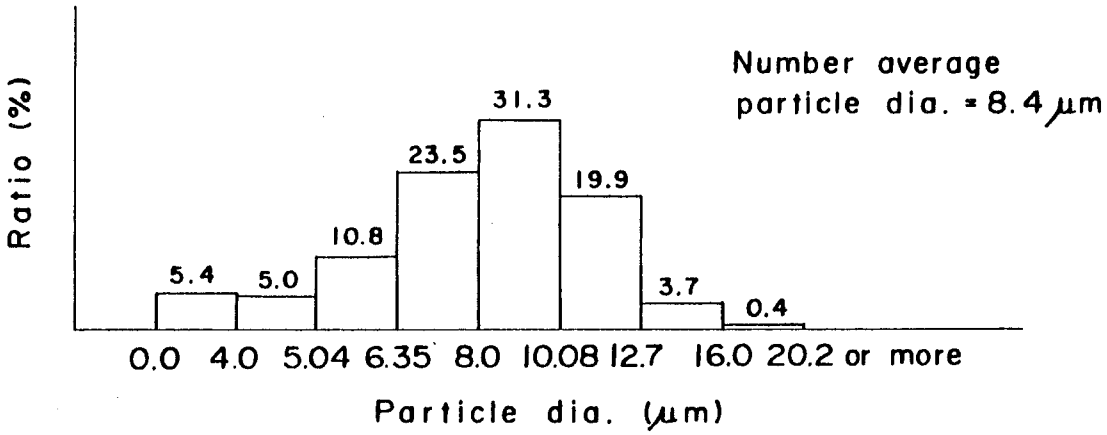
FIG. 7 is a graph showing one example of FIG. 5.
Figure 8:
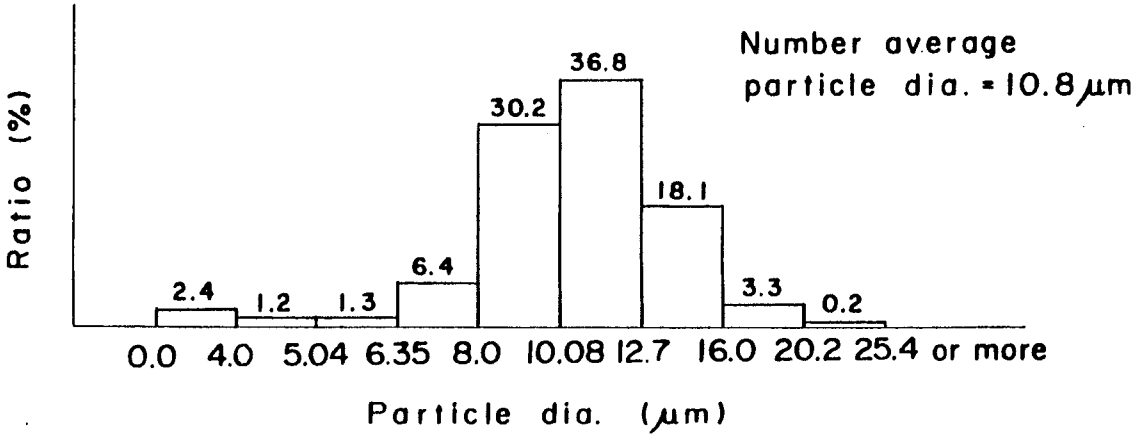
FIG. 8 is a graph showing one example of FIG. 6.

(iii) The evaluation coefficient K is obtained in a concrete case. Initially, by classifying the first toner and the second toner to be examined, ratios that the first toner and the second toner fall in predetermined ranges of particle diameters are obtained as shown in FIGS. 7 and 8, respectively. Then, as shown in Table 1 below, a value of ($P_i\cdot X_i$) is obtained for each range of particle diameters on the basis of the above equation (1) and the evaluation coefficient, K ($=\Sigma P_i\cdot X_i$) is obtained from a total of the values of ($P_i\cdot X_i$). In this case, the evaluation coefficient K assumes 0.26, i.e. K=0.26.

TABLE 1

| i | Particle dia. (μm) | $P_i$ ($\times 10^{-2}$) | $X_i$ ($\times 10^{-2}$) | $P_i\cdot X_i$ ($\times 10^{-4}$) |
|---|---|---|---|---|
| 1 | 0.00–4.00 | 0.5 × 2.4 = 1.2 | 5.4 | 6 |

TABLE 1-continued

| i | Particle dia. (μm) | $P_i$ (× $10^{-2}$) | $X_i$ (× $10^{-2}$) | $P_i \cdot X_i$ (× $10^{-4}$) |
|---|---|---|---|---|
| 2 | 4.00–5.04 | 0.5 × 1.2 + 2.4 = 3.0 | 5.0 | 15 |
| 3 | 5.04–6.35 | 0.5 × 1.3 + 1.2 + 2.4 = 4.25 | 10.8 | 46 |
| 4 | 6.35–8.00 | 0.5 × 6.4 + 1.3 + 1.2 + 2.4 = 8.1 | 23.5 | 190 |
| 5 | 8.00–10.08 | 0.5 × 30.2 + 6.4 + 1.3 + 1.2 + 2.4 = 26.4 | 31.3 | 826 |
| 6 | 10.08–12.7 | 0.5 × 36.8 + 30.2 + 6.4 + 1.3 + 1.2 + 2.4 = 59.9 | 19.9 | 1192 |
| 7 | 12.7–16.0 | 0.5 × 18.1 + 36.8 + 30.2 + 6.4 + 1.3 + 1.2 + 2.4 = 87.35 | 3.7 | 323 |
| 8 | 16.0–20.2 | 0.5 × 3.3 + 18.1 + 36.8 + 30.2 + 6.4 + 1.3 + 1.2 + 2.4 = 98.05 | 0.4 | 39 |
| | | | $K = \Sigma P_i \cdot X_i = 2637 \times 10^{-4}$ | |

IX. [Experiments on Mixing of the Colors]

By setting the first and second developing devices and 5 to the following conditions, degree of mixing of the colors was observed.

(i) Setting conditions of the image forming apparatus:

a. The photosensitive member is OPC (organic photo conductor) type and has a diameter of 100 mm and a system speed of 110 mm/sec.

b. The first developing device 3 has the following conditions.

The carrier is spherical ferrite carrier having an average particle diameter of 60 μm and charged to positive polarity.

The first toner is non-magnetic color toner having a number average particle diameter of 8.4 μm and charged to negative polarity. The first toner comprises 100 parts by weight of styrene acrylic copolymer, 4 parts by weight of negative charging control agent for controlling negative charging and 5 parts by weight of red pigment. In order to manufacture the first toner, the above mentioned compositions are molten, mixed, cooled, ground and then, classified. Concentration of the first toner, i.e. ratio in weight of the first toner to be mixed with the carrier to the carrier is 5 wt. %.

c. The second developing device 5 has the following conditions.

The carrier is binder type carrier having an average particle diameter of 58 μm and charged to positive polarity.

The second toner is magnetic black toner having a number average particle diameter of 8.9 μm and charged to negative polarity. The second toner comprises 100 parts by weight of styrene acrylic copolymer, 5 parts by weight of control agent for controlling negative charging, 4 parts by weight of carbon black and 40 parts by weight of magnetic powder. The second toner is manufactured in the same manner as the first toner referred to above. Concentration of the second toner is 15 wt. %.

d. Number average particle diameters of the first toner and the second toner are shown in Table 2 below.

TABLE 2

| Experiment No. | Average particle dia. (μm) First toner | Average particle dia. (μm) Second toner | Evaluation coefficient K |
|---|---|---|---|
| 1 | 8.4 | 8.9 | 0.64 |
| 2 | 10.0 | 8.9 | 0.55 |
| 3 | 10.0 | 10.9 | 0.45 |
| 4 | 8.4 | 10.9 | 0.29 |
| 5 | 6.8 | 10.9 | 0.18 |
| 6 | 6.8 | 13.4 (*1) | 0.10 |

TABLE 2-continued

| Experiment No. | Average particle dia. (μm) First toner | Average particle dia. (μm) Second toner | Evaluation coefficient K |
|---|---|---|---|
| 7 | 6.8 | 11.0 (*2) | 0.14 |

The note (*1) indicates that the second toner is obtained by classifying the second toner having an average particle diameter of 10.9 μm and used in the experiment Nos. 3–5 so as to reduce particles having a diameter of 10 μm or less.
The note (*2) indicates that the second toner is obtained by classifying the second toner having an average particle diameter of 8.9 μm and used in the experiment Nos. 1 and 2 so as to reduce particles having a diameter of 8 μm or less.

Figure 9:
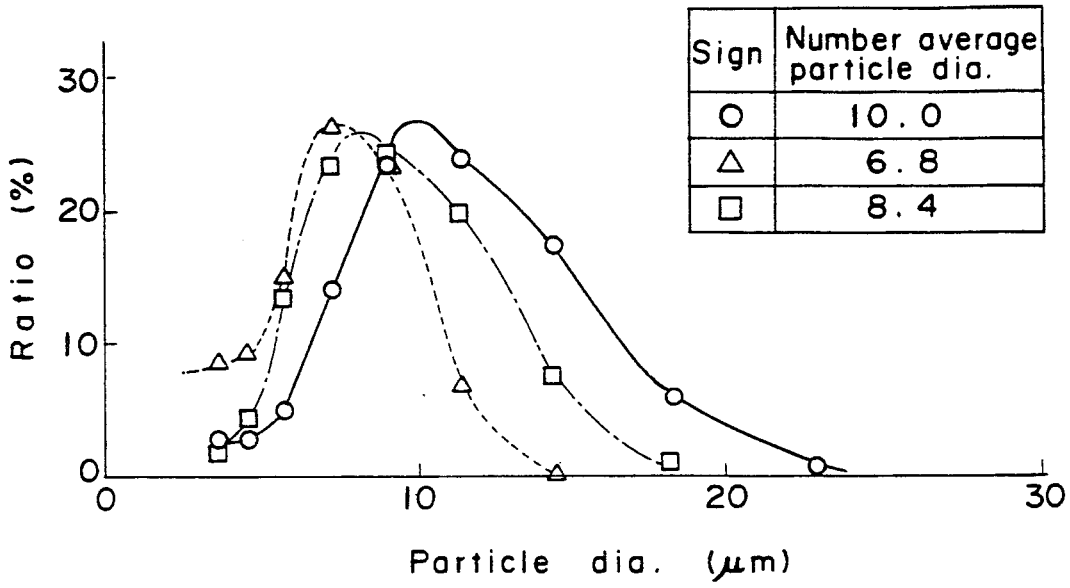
FIGS. 9 and 10 are graphs showing distribution of particle diameters of first and second toners employed in experiments, respectively.

FIG. 9 shows distribution of particle diameters of the first toner (color toner) used in the experiment Nos. 1–6.

Figure 10:
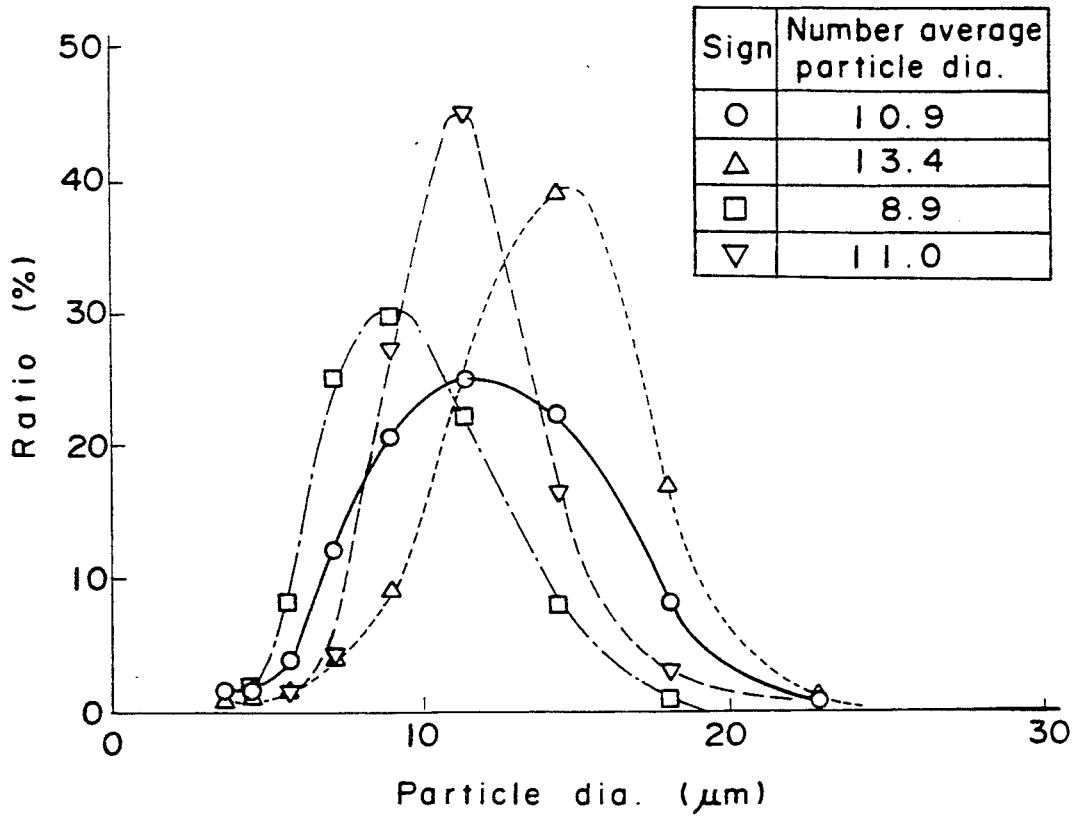

FIG. 10 shows distribution of particle diameters of the second toner (black toner) used in the experiment Nos. 1–6.

Meanwhile, it is to be noted that the term "number average particle diameter" denotes a central particle diameter in view of the number of particles of the toner, namely is expressed by (total of the particle diameters of the toner) / (the number of particles of the toner).

(ii) Experimental method:

The first developing device utilizing the above first toner and the second developing device utilizing the above second toner are driven simultaneously such that the a solid color image is formed by the first developing device. Then, the color image is passed through an area confronting the second developing device so as to be transferred to a paper sheet and thus, an image sample is obtained without fixing of the color image.

Subsequently, this image sample is magnified 20 times by an optical microscope and the number of particles of the second toner present in the visual field corresponding to about 0.57 mm: in the real image is counted. Meanwhile, the solid image is visually inspected such that mixing of the colors is evaluated visually.

(iii) Experimental results:

The number of particles of the mixed second toner, i.e. the number of particles of the second toner present in the image sample in the visual field is shown in Table 3 below.

TABLE 3

| Experiment No. | K | Number of particles of second toner (m) |
|---|---|---|
| 1 | 0.64 | 160 |
| 2 | 0.55 | 120 |
| 3 | 0.45 | 96 |
| 4 | 0.29 | 60 |
| 5 | 0.18 | 40 |
| 6 | 0.10 | 23 |
| 7 | 0.14 | 31 |

Figure 11:
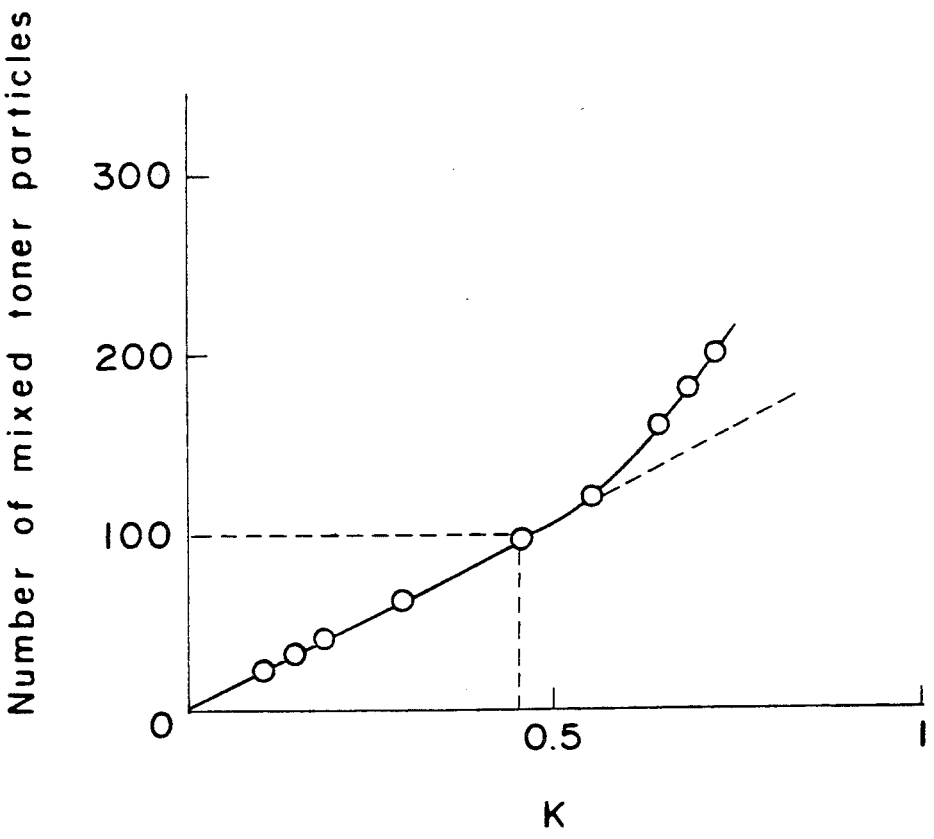
FIG. 11 is a graph showing relation between evaluation coefficient for evaluating mixing of colors and the number of mixed toner particles in microscopic visual field.

Results of Table 3 are shown in FIG. 11.

As a result of visual inspection of the image samples of the experiment Nos. 1-6, it was found that mixing of the colors takes place obviously in the image sample of the experiment No. 1 (m=160).

In the image sample of the experiment No. 2 (m=120), mixing of the colors is not so conspicuous and is in such a degree as to be perceptible anyhow. In the image samples of the experiment Nos. 3-7 (m=23 to 96), mixing of the colors is not outstanding and is in such a degree as to be imperceptible at sight.

From the above, a decision as to whether or not mixing of the colors in the image is visually outstanding can be made based on whether or not 100 particles of the toner having the color different from that of the toner image are present in the toner image of about 0.57 $mm^2$.

Therefore, as shown in FIG. 9, if the evaluation coefficient K is not more than 0.50, preferably not more than 0.45, the number of particles of the mixed toner present in the toner image of about 0.57 $mm^2$ can be reduced to 100 or less and thus, mixing of the colors can be restricted to a negligible level for practical use. Namely, assuming that character $\alpha$ denotes a limit of mixing of the colors, the evaluation coefficient K should satisfy the following equation to this end.

$$K = \sum_{i=2}^{n}\left[X_i \cdot \left\{ (\tfrac{1}{2})Y_i + \sum_{i=2}^{i-1} Y_i \right\}\right] \leqq \alpha(=0.5)$$

At this time, it becomes possible to obtain an image free from apparent mixing of the colors.

IV. [Others]

In the above experiments, mixing of the colors is observed by employing red toner and black toner as the first toner and the second toner, respectively and the limit $\alpha$ (=0.5) of mixing of the colors is obtained with respect to the red toner and the black toner. However, the number of particles of the mixed toner, which leads to perception of mixing of the colors, changes according to colors of the toners to be mixed. Namely, whether or not mixing of the colors is outstanding changes according to lightness, saturation and hue of colors of the toners to be mixed. For example, the number of particles of the mixed black toner, which leads to perception of mixing of the colors in the case where the black toner is mixed into an image formed by blue toner is larger than that of the case where the black toner is mixed into the image formed by the red toner. Namely, in the case where the black toner is mixed into the first image formed by the blue toner, the first image can be reproduced without deterioration of the tone when not only the number of the black toner mixed into the first image is not more than about 200 per about 0.57 $mm^2$ of the first image but the limit $\alpha$ of mixing of the colors is about 0.7 or less.

Accordingly, in individual color combinations, the above experiments are required to be performed. Thus, the number of particles of the mixed toner, which does not lead to perception of mixing of the colors, is counted from the obtained image samples and the limit $\alpha$ corresponding to this number is determined. Then, the toners are prepared such that the evaluation coefficient K satisfies relation of ($K \leqq \alpha$).

As is clear from the foregoing description, in the multi-color image forming apparatus according to first embodiment of the present invention, the first toner of the magnetic brush type first developing device and the second toner of the magnetic brush type second developing device disposed downstream of the first developing device in the direction of travel of the photosensitive member are prepared such that the evaluation coefficient K for evaluating mixing of the colors is not more than the limit $\alpha$ of mixing of the colors. Therefore, in accordance with the first embodiment of the present invention, the number of particles of the second toner mixed into the image formed by the first toner is reduced such that mixing of the colors can be restricted to a negligible level for practical use. Accordingly, the image formed by the first toner can be reproduced without deterioration of the tone.

Hereinbelow, an image forming apparatus K2 according to a second embodiment of the present invention is described.

I. [Arrangement of the Image Forming Apparatus K2]

Figure 12:
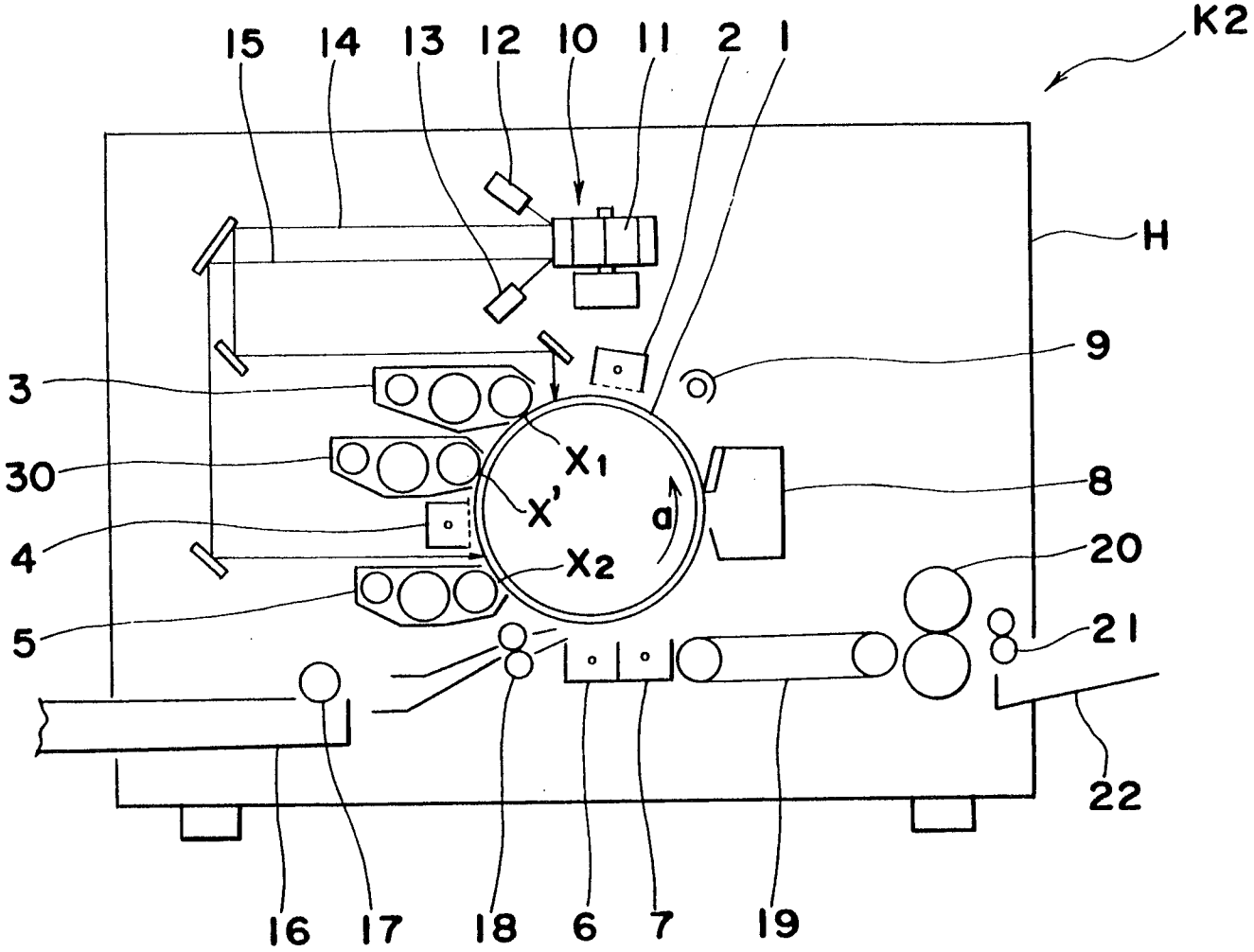
FIG. 12 is a schematic sectional view of an image forming apparatus according to a second embodiment of the present invention.

FIG. 12 shows the image forming apparatus K2. The apparatus K2 is different from the apparatus K1 only in that the apparatus K2 further includes a third developing device 30 disposed between the first developing device 3 and the second corona charger 4. Since other constructions of the apparatus K2 are similar to those of the apparatus K1, description thereof is abbreviated for the sake of brevity.

Meanwhile, a developing bias VB3 is applied to the sleeve 33 of the third developing device 30. The third developing device 30 is of magnetic brush type in the same manner as the first and second developing devices 3 and 5 and is structurally identical with the first and second developing devices 3 and 5. The third developing device 30 employs color toner having a color identical with that of the color toner of the first developing device 3. The following developers are accommodated in the first, second and third developing devices 3, 5 and 10, respectively.

(a) First developing device 3:

The carrier is spherical ferrite carrier having an average particle diameter of 60 μm and charged to positive polarity.

The first toner is non-magnetic color toner having an average particle diameter of 12 μm and charged to negative polarity. The first toner comprises 100 parts by weight of styrene acrylic copolymer, 4 parts by weight of control agent for controlling negative charging and 5 parts by weight of red pigment. The first toner has a concentration of 5 wt. %.

(b) Second developing device 5:

The carrier is binder type carrier having an average particle diameter of 58 μm and charged to positive polarity.

The second toner is magnetic black toner having an average particle diameter of 12 μm and charged to negative polarity. The second toner comprises 100 parts by weight of styrene acrylic copolymer, 5 parts by weight of control agent for controlling negative charging, 4 parts by weight of carbon black and 40 parts by weight of magnetic powder. The second toner has a concentration of 15 wt. %.

(c) Third developing device 30:

The carrier is spherical ferrite carrier having an polarity.

The third toner is non-magnetic color toner having an average particle diameter of 6 μm and charged to negative polarity. Compositions of the third toner are the same as those of the first toner. The third toner has a concentration of 8 wt. %.

II. [Two-color Image Forming Operations]

Figure 13:
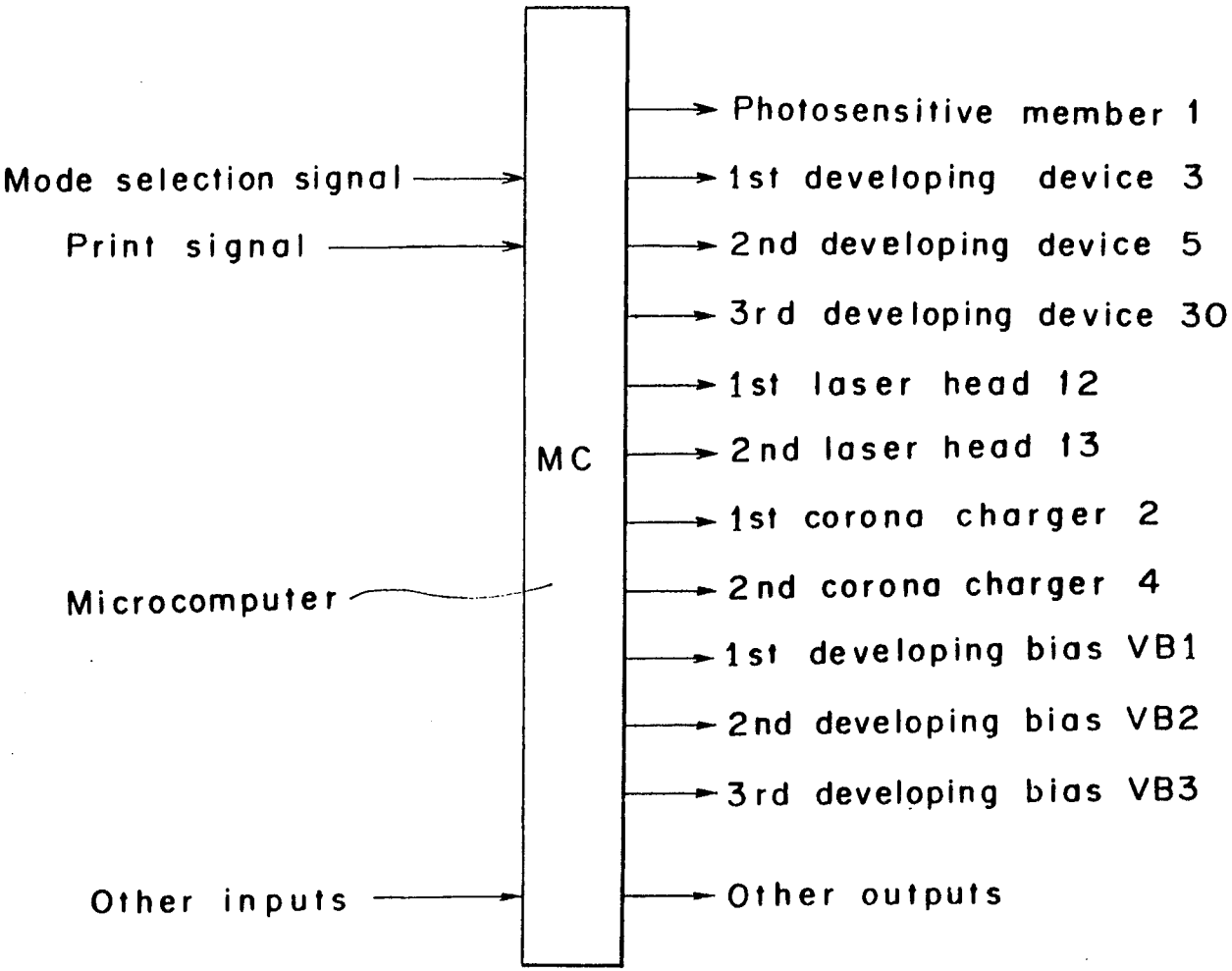
FIG. 13 is a diagram showing a control circuit of the image forming apparatus of FIG. 12.
Figure 14A:
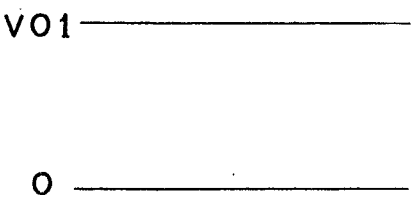
FIGS. 14*a* to 14*h* are explanatory of a two-color image forming method according to the present invention.
Figure 14B:
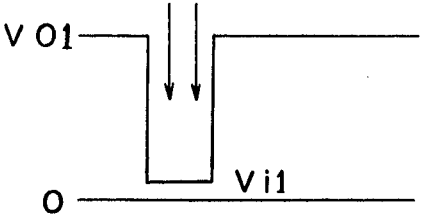
Figure 14C:
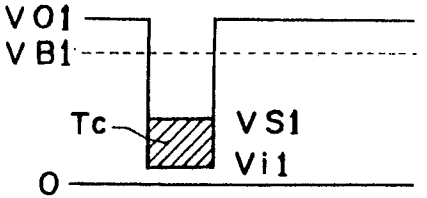
Figure 14D:
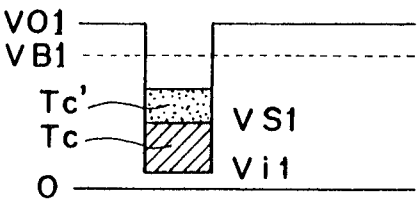
Figure 14E:
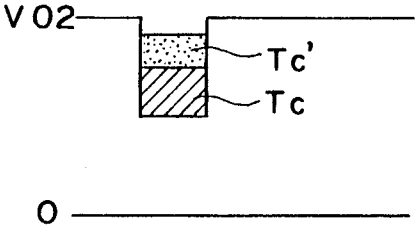
Figure 14F:
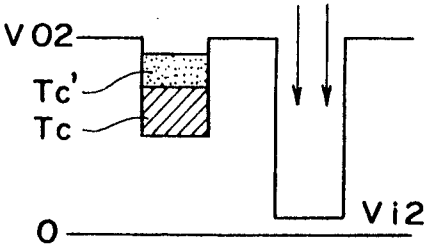
Figure 14G:
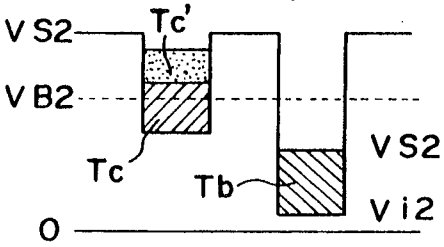
Figure 14H:
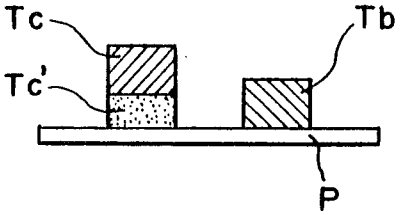
Figure 15:
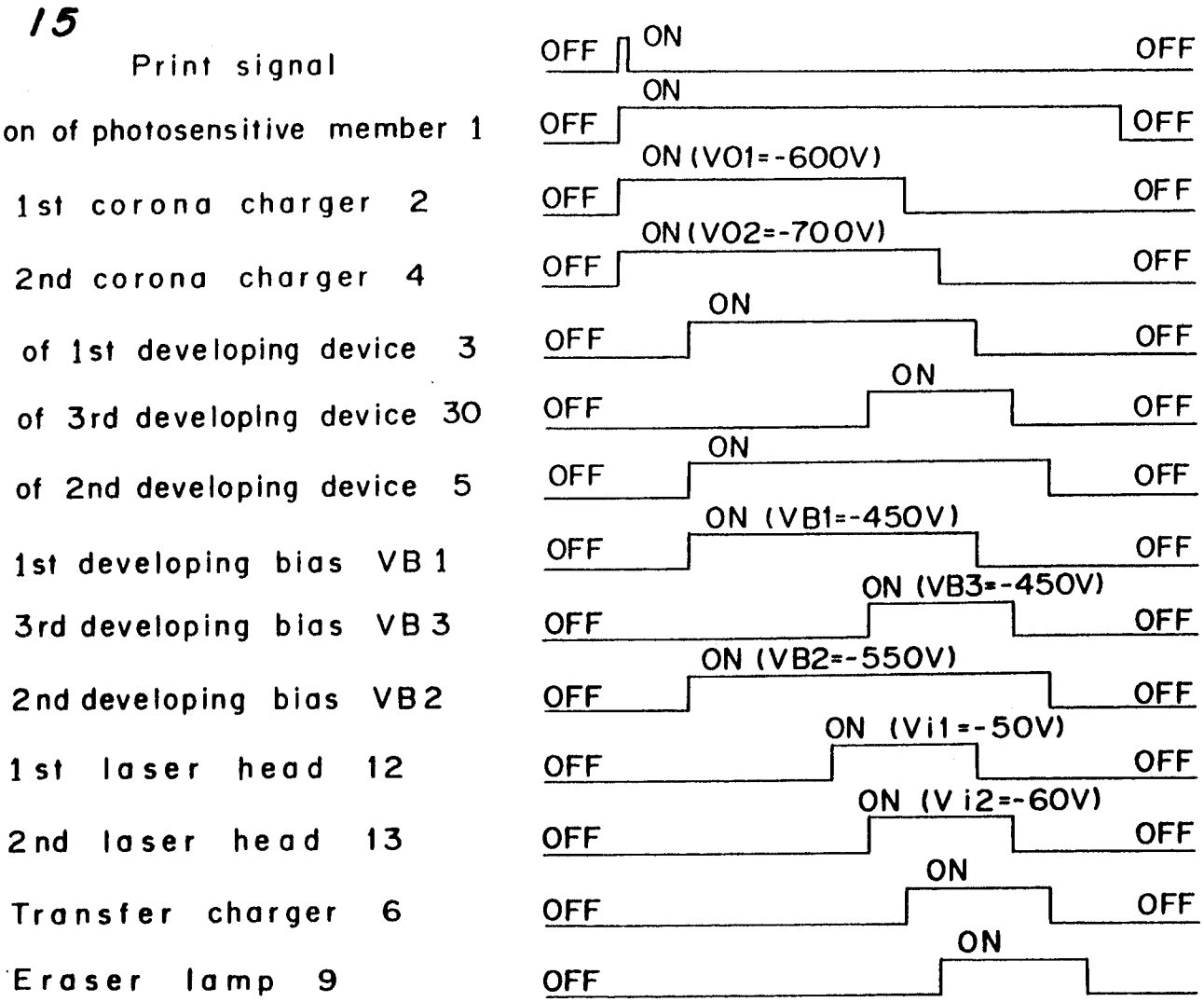
FIG. 15 is a timing chart of the two-color image forming method of FIGS. 14*a* to 14*h*.

The image forming apparatus K2 of the above described arrangement is controlled by a microcomputer MC shown in FIG. 13 such that a two-color image is formed in accordance with processes of FIGS. 14*a* to 14*h* and a timing chart of FIG. 15.

(a) First corona charging process (FIG. 14*a*):

When a print signal has been inputted to the microcomputer MC, the photosensitive member 1 is rotated in the direction of the arrow a and the first corona charger 2 performs electric discharge so as to charge a outer peripheral surface of the photosensitive member 1 to a predetermined surface potential V01 of −600 V.

Meanwhile, upon lapse of a predetermined period in the first and second developing devices 3 and 5, the sleeve 33 is rotated in the direction of the arrow b and the developing biases VB1 and VB2 are set at −450 V and −550 V, respectively.

(b) First exposure process (FIG. 14*b*):

In the optical system 10, the laser beam 14 corresponding to the color image is emitted from the firs laser head 12 to the rotary polygon mirror 11 and its reflected beam is irradiated, via mirrors, for exposure onto an exposure portion of the photosensitive member 1 from between the first corona charger 2 and the first developing device 3 so as to set a surface potential Vil of the exposure portion at −50 V such that a first latent image is formed.

(c) First development process (FIG. 14*c*):

Through travel of the photosensitive member 1, the first latent image is transported to the first developing region $X_1$.

In the first developing region $X_1$, the color toner Tc charged to negative polarity adheres to the electrostatic latent image due to an electrostatic contrast of 400 V between the developing bias VB1 of −450 V and the surface potential Vil of −50 V at the exposure portion of the photosensitive member 1 so as to develop the electrostatic latent image into a visible color toner image.

Meanwhile, since all the above electrostatic contrast of 400 V is not neutralized by current of the toner, the color toner image has a surface potential VS1 of about −250 V.

(d) Masking process (FIG. 14*d*):

Subsequently, the third developing device 30 is driven and the developing bias VB3 is set at −450 V. Through travel of the photosensitive member 1, the color toner image referred to above is conveyed to a region confronting the third developing device 30 (hereinbelow, referred to as a "masking region X'").

In the masking region X', the small-diameter color toner Tc' having an average particle diameter of 6 μm and charged to negative polarity is put on the color toner image for its development due to an electrostatic contrast of about 200 V between the developing bias VB3 of −450 V and the surface potential VS1 of about −250 V of the color toner image. Namely, the surface of the color toner image formed by the first toner having an average particle diameter of 12 μm is masked by the small-diameter color toner Tc' having a color identical with that of the first toner and having an average particle diameter of 6 μm.

(e) Second corona charging process (FIG. 14*e*):

When the masked color toner image on the photosensitive member 1 reaches an area confronting the second corona charger 4, the outer peripheral surface of the photosensitive member 1 is again charged to a surface potential V02 of −700 V.

(f) Second exposure process (FIG. 14*f*):

In the optical system 10, the laser beam 15 corresponding to the black image is emitted from the second laser head 13 to the rotary polygon mirror 11 and its reflected beam is irradiated, through mirrors, for exposure onto an exposure portion of the photosensitive member 1 from between the second corona charger 4 and the second developing device 5 so as to set a surface potential Vi2 of the exposure portion at −60 V such that a second latent image is formed.

(g) Second development process (FIG. 14*g*):

The second latent image is conveyed to the second developing region $X_2$ through rotation of the photosensitive member 1. At the second developing region $X_2$, the black toner Tb charged to negative polarity is supplied from the second developing device 5 to the electrostatic latent image due to an electrostatic contrast of 490 V between the second developing bias VB2 of −550 V and the surface potential Vi2 of −60 V at the exposure portion of the photosensitive member 1 so as to develop the second electrostatic latent image into a black toner image.

Meanwhile, at the second developing region $X_2$, the magnetic brush formed by the second developer is brought into contact with the surface of the color toner image formed by the color toner Tc and the color toner Tc' so a to scrape a superficial portion of the color toner Tc and the color toner Tc' from the color toner image. It is to be noted that the toner to be scraped from the color toner image at this time is the small-diameter color toner Tc' having an average particle diameter of 6 μm.

Therefore, a recess formed at the location where the color toner Tc' has been scraped is small. Thus, a probability that the large-diameter color toner Tc having an average particle diameter of 12 μm fills up this recess is quite low. Experiments to be described later have revealed that only several tens of particles of the black toner penetrate into a unit area of 0.57 $mm^2$ of the color toner image. As a result, visual inspection of the color toner image does not lead to perception of the black toner mixed into the color toner image.

(h) Transfer process (FIG. 14*h*):

The color toner Tc, the color toner Tc' and the black toner Tb, which have adhered to the outer peripheral surface of the photosensitive member 1 as described above, are transferred to the transfer medium P at the portion of the photosensitive member 1 confronting the transfer charger 6. The transfer medium P having the toners Tc, Tc' and Tb transferred thereto is separated from the surface of the photosensitive member 1 by the charge eraser 7 and is conveyed by the transport belt 19 to the fixing device 20 at which the color toner Tc, the color toner Tc' and the black toner Tb are heated so as to be fixed on the transfer medium P. Subsequently, the transfer medium P is ejected onto the discharge tray 22 by the outlet rollers 21.

IV. [Others]

In the second embodiment of the present invention, the color toner having the color identical with that of the color toner of the first developing device 3 is employed in the third developing device 30 as described above but may also be replaced by colorless transparent toner having a small average particle diameter. In this case, the surface of the color toner image formed by the first developing device 3 is masked by the small-diameter transparent toner, whereby the same effects as described above can be achieved. Meanwhile, this colorless transparent toner does not contain pigment naturally and for example, chlorinated polyolefin or dibutyl tin oxide is used as agent for controlling electric current.

By using the image forming apparatus K2, the present inventors have performed the above mentioned experiments so as to examine causes of mixing of the colors. In the experiments, particle diameters of the toners accommodated in the first and second developing devices 3 and 5 are changed variously such that two-color images are formed. Then, the number of particles of the second toner (black toner) mixed into the color toner image of the first toner is counted in the visual field of 0.57 $mm^2$ of the optical microscope having a magnification of 200 and the image quality is visually inspected. The results are shown in Table 4 below.

TABLE 4

| Exp. No. | Average particle dia. (μm) First toner | Second toner | Number of particles of mixed toner | Image quality |
|---|---|---|---|---|
| 1 | 14 | 12 | 160 | C |
| 2 | 14 | 14 | 120 | B |
| 3 | 11.5 | 14 | 96 | A |
| 4 | 9 | 14 | 60 | A |
| 5 | 9 | 18 | 35 | A |

In the column "Image quality" of Table 4 above, character A denotes that mixing of the colors is imperceptible, character B denotes that mixing of the colors is slightly perceptible and character C denotes that mixing of the colors is clearly perceptible.

The experiments have revealed that when the average particle diameter of the first toner is larger than that of the second toner as in the experiment No. 1, the number of particles of the mixed second toner is increased, thereby resulting in enormous mixing of the colors.

When the average particle diameter of the first toner is made identical with that of the second toner as in the experiment No. 2, the number of particles of the mixed second toner is reduced in comparison with the experiment No. 1 and mixing of the colors is slightly perceptible visually.

In the case where the average particle diameter of the first toner is made smaller than that of the second toner as in the experiment Nos. 3–5, mixing of the colors is imperceptible visually.

From the above, it can be understood that the average particle diameters of the first toner and the second toner are closely related to mixing of the colors and that by making the average particle diameter of the first toner smaller than that of the second toner, the number of particles of the mixed second toner in the predetermined visual field can be reduced and thus, apparent mixing of the colors can be restricted to a negligible level for practical use.

Meanwhile, when the first toner image is brought into contact with the second developer, the first toner of the first toner image is scraped by the second developer. Thus, at a location of the first toner image where the first toner has been scraped by the second developer, a recess is formed. Therefore, it is considered that mixing of the colors takes place when a portion of the second toner, which has a particle diameter smaller than that of the first toner, penetrates into the recess.

Therefore, if the first toner image, especially its superficial portion is formed by the small-diameter toner particles and the average particle diameter of the second toner is made larger than that of the small-diameter toner forming the superficial portion of the first toner image, the recess formed at the location of the first toner image where the small-diameter toner is scraped by the second toner is small. Consequently, it is concluded that mixing of the colors through penetration of the second toner into the recess seldom takes place.

As will be seen from the foregoing description, in the two-color image forming method and apparatus according to the second embodiment of the present invention, the surface of the first toner image is masked by the toner which has the color identical with that of the first tone or is colorless transparent toner and has a particle diameter smaller than those of the first and second toners.

Accordingly, even if the second developer is brought into contact with the first toner image, the recess formed on the surface of the first toner image through contact of the second developer with the first toner image is small, so that a probability that mixing of the colors through penetration of the large-diameter second toner into the recess is quite low and thus, an image free from apparent mixing of the colors is obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An image forming apparatus comprising:

an image support member;

a first electrostatic latent image forming means for forming a first electrostatic latent image on said image support member;

a first developing means for developing the first electrostatic latent image with first toner;

a second electrostatic latent image forming means for forming a second electrostatic latent image on said image support member; and a second developing means for developing the second electrostatic latent image with second toner;

the second toner having a color different from that of the first toner and having charger characteristics relative to carrier, identical with those of the first toner;

the second toner having an average particle diameter larger than that of the first toner;

the first toner and the second toner are preliminarily prepared so as to satisfy the following equation:

$$K = \sum_{i=2}^{n} \left[ X_i \cdot \left\{ (\tfrac{1}{2}) Y_i + \sum_{i=2}^{i-1} Y_i \right\} \right] \leq \alpha$$

K denoting a value indicative of likelihood of mixing of the colors, character $X_i$ denotes a ratio of a portion of the first toner falling in a range of particle diameters from $r_{i-1}$ to $r_i$ to a whole of the first toner, character $Y_i$ denotes a ratio of a portion of the second toner falling in a range of particle diameters from $r_{i-1}$ to $r_i$ to a whole of the second toner and character $\alpha$ denotes a coefficient indicative of a limit of mixing of the colors; and wherein the value K is not more than 0.5, preferably not more than 0.45.

2. An image forming apparatus comprising:

a photosensitive member;

a first charging means for charging said photosensitive member;

a first electrostatic latent image forming means for forming a first electrostatic latent image on said charged photosensitive member;

a first developing means for developing the first electrostatic latent image with first toner so as to form a first toner image;

a redeveloping means for developing the first toner image with redeveloping toner which is charged to a polarity identical with that of the first toner and has particle diameters smaller than those of the first toner;

a second charging means for changing said photosensitive member again;

a second electrostatic latent image forming means for forming a second electrostatic latent image on said photosensitive member; and a second developing means for developing the second electrostatic latent image with second toner so as to form a second toner image;

the second toner being charged to a polarity identical with that of the first toner through its contact with carrier.

3. An image forming apparatus as claimed in claim 2, further comprising:

a transfer means for transferring the first toner image and the second toner image to a transfer medium at a time.

4. An image forming apparatus as claimed in claim 2, wherein the redeveloping toner has a color identical with that of the first toner or is transparent.

5. An image forming apparatus as claimed in claim 4, wherein particle diameters of the second toner are larger than those of the redeveloping toner.

6. An image forming apparatus as claimed in claim 5, wherein the first toner is non-magnetic toner and the second toner is magnetic toner.

7. An image forming method comprising:

a first charging step of charging a photosensitive member;

a first electrostatic latent image forming step of forming a first electrostatic latent image on said charged photosensitive member;

a first developing step of developing the first electrostatic latent image with first toner so as to form a first toner image;

a masking step of redeveloping the first toner image with toner which is charged to a polarity identical with that of the first toner and has particle diameters smaller than those of the first toner;

a second charging step of charging said photosensitive member again;

a second electrostatic latent image forming step of forming a second electrostatic latent image on said photosensitive member; and a second developing step of developing the second electrostatic latent image with second toner so as to form a second toner image;

the second toner being charged to a polarity identical with that of the first toner through its contact with carrier.

8. An image forming method as claimed in claim 7, further comprising:

a transfer step of transferring the first toner image and the second toner image to a transfer medium at a time.

9. An image forming method as claimed in claim 7, wherein the toner used in the masking step has a color identical with that of the first toner or is transparent.

10. An image forming method as claimed in claim 9, wherein particle diameters of the second toner are larger than those of the toner used in the masking step.

11. An image forming method as claimed in claim 10, wherein the first toner is non-magnetic toner and the second toner is magnetic toner.

12. An image forming apparatus comprising:

an image support member;

an electrostatic latent image forming means for forming first and second electrostatic latent images on said image support member;

a first developing means for developing the first electrostatic latent image with first toner having a plurality of classes with respect to its particle diameter; and a second developing means for developing the second electrostatic latent image with second toner;

the second toner having a color different from that of the first toner and having charging characteristics, relative to a carrier, identical with those of the first toner;

the second toner having a plurality of classes with respect to its particle diameter;

wherein when one of the plurality of classes of the first toner is identical with a specific one of the plurality of classes of the second toner, in which the particle diameter of the second toner is smaller than an average particle diameter of the second toner, a ratio of the second toner belonging to the specific one of the classes is smaller than that of the first toner belonging to the one of the classes; and when a further one of the plurality of classes of the first toner is identical with a further specific one of the plurality of classes of the second toner in which the particle diameter of the second toner is larger than the average particle diameter of the second toner, a ratio of the second toner belonging to the further specific one of the classes is larger than that of the first toner belonging to the further one of the classes.

13. An image forming apparatus as claimed in claim 12, wherein the first toner and the second toner are preliminarily prepared so as to satisfy the following equation:

$$K = \sum_{i=2}^{n} \left[ X_i \cdot \left\{ (\tfrac{1}{2}) Y_i + \sum_{i=2}^{i-1} Y_i \right\} \right] \leqq \alpha$$

where character K denotes a value indicative of likelihood of mixing of the colors, character $X_i$ denotes a ratio of a portion of the first toner falling in a range of particle diameters from $r_{i-1}$ to $r_i$ to a whole of the first toner, character $Y_i$ denotes a ratio of a portion of the second toner falling in a range of particle diameters from $r_{i-1}$ to $r_i$ to a whole of the second toner and character $\alpha$ denotes a coefficient indicative of a limit of mixing of the colors.

* * * * *